US007438201B2

(12) United States Patent
Kim

(10) Patent No.: US 7,438,201 B2
(45) Date of Patent: Oct. 21, 2008

(54) APPARATUS FOR DETECTING OF DROPPING TABLETS IN AUTOMATIC MEDICINE PACKAGING MACHINE

(75) Inventor: Jun-ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 248 days.

(21) Appl. No.: 11/178,327

(22) Filed: Jul. 12, 2005

(65) Prior Publication Data

US 2006/0273106 A1 Dec. 7, 2006

(30) Foreign Application Priority Data

Jun. 1, 2005 (KR) ..... 10-2005-0046869

(51) Int. Cl.
*B65H 3/60* (2006.01)

(52) U.S. Cl. ..... 221/200; 221/311; 221/312 R; 221/312 A; 221/280; 221/289; 221/290; 221/292; 221/293; 221/205; 221/7

(58) Field of Classification Search ..... 221/1–312 C
See application file for complete search history.

(56) References Cited

U.S. PATENT DOCUMENTS 5,678,393 A * 10/1997 Yuyama et al. ..... 53/493
6,405,893 B1 * 6/2002 Tobe et al. ..... 221/2
6,481,180 B1 * 11/2002 Takahashi et al. ..... 53/237
6,928,790 B2 * 8/2005 Takahashi et al. ..... 53/247
7,191,034 B2 * 3/2007 Whitten et al. ..... 700/244
7,228,988 B2 * 6/2007 Inamura ..... 221/65
2005/0145644 A1 * 7/2005 Mori et al. ..... 221/242
2006/0016827 A1 * 1/2006 Hatsuno et al. ..... 221/277

* cited by examiner

*Primary Examiner*—Gene O. Crawford
*Assistant Examiner*—Michael K Collins
(74) *Attorney, Agent, or Firm*—Oblon, Spivak, McClelland, Maier & Neustadt, P.C.

(57) ABSTRACT

An apparatus for precisely, detecting a tablet dropped in a last hopper so that packaging speed of tablets is increased and operation of a shutter and a sealer is precisely performed, is disclosed. The automatic medicine packaging machine includes a last hopper provided at the lower end of a hopper installed in a main frame, a shutter installed in the last hopper, and a shutter driving part for driving the shutter to open and close the last hopper, and the apparatus includes a dropping tablet detector installed in the last hopper to detect when the tablet is dropped into the last hopper and to input the detected information about the dropping tablet to the controller such that the moment when the shutter is opened is optimized.

4 Claims, 8 Drawing Sheets

APPARATUS FOR DETECTING OF DROPPING TABLETS IN AUTOMATIC MEDICINE PACKAGING MACHINE

BACKGROUND OF THE INVENTION

1. Field of the Invention

The present invention relates to an automatic medicine packaging machine, and more particularly, to an apparatus for precisely detecting that a tablet is dropped in a last hopper so that packaging speed of tablets is increased and operation of a shutter and a sealer is precisely performed.

2. Description of the Related Art

Generally, an automatic medicine packaging machine indicates an apparatus for automatically packaging medicines into doses.

The structure and operation of a conventional automatic medicine packaging machine will be described with reference to FIG. 7 schematically depicting the conventional automatic medicine packaging machine.

As shown in FIG. 7, the conventional automatic medicine packaging machine includes a plurality of tablet cassettes 200 installed on a shelf disposed at the upper side of a main body 100, a hopper 300 having a last hopper 301 installed at the lower side of the tablet cassettes 200, a pair of packaging sheet rolls 400 disposed at the lower lateral sides of the hopper 300, a printer 500 installed at the lower side of one of the packaging rolls 400 to print information such as the patient name, how to take the medicine, or the like, a pair of driving rollers 600 installed below the hopper 300, a sealer 700 disposed between the hopper 300 and the driving rollers 600 to seal the packaging sheets to form a series of medicine packets R, and a punch 800 disposed below the sealer 700 to form holes in the series of medicine packets R.

In such conventional automatic medicine packaging machine, the tablets, dropped into the hopper 300 from the tablet cassettes 200, are inserted between a pair of packaging sheets drawn from the packaging rolls 400 by the driving rollers 600, and the sealer 700 seals the packaging sheets traveling downward to finish a series of medicine packets R and to discharge the series of medicine packets R through the lower side of the main body 100.

The discharged series of medicine packets R is fed from the lower side of the main body 100 to the lateral side of the main body 100 by a feeder 900 and discharged out through the lateral side of the main body 100.

The automatic medicine packaging machine and its devices are controlled by a controller 100*a*.

FIG. 8 is an enlarged rear perspective view illustrating the conventional automatic medicine packaging machine.

As shown in the drawing, the conventional automatic medicine packaging machine includes the last hopper 301 disposed at the lower side of the hopper 300 installed at a main frame 101 of the main body 100, a shutter 302 installed in the last hopper 301, and a shutter driving part 303 for driving the shutter 302 to open and close the last hopper 301.

The shutter driving part 303 includes a rotation cam 305 rotated by a motor 304, a rotation link 306 connected to the rotation cam 305, a connection link 307 connected to the rotation link 306, a rotation shaft 308 coupled with a connection link 307 and penetrating the main frame 101 to rotate, and a trigger 309 installed to the end of the rotation shaft 308 and rotated by the rotation shaft 308.

The trigger 309 rotates to press a crank bar 302*a* installed to the upper outer side of the shutter 302 so that the shutter 302 is opened and the tablets accommodated in the last hopper 301 are discharged through the lower side thereof.

However, the conventional automatic medicine packaging machine has the following disadvantages.

Since the time within which the medicine tablets are discharged from the respective tablet cassettes and are dropped in the last hopper is not uniform, a time delay is set to the shutter opening time and the sealing time of the sealer. Due to the preset time delay, the packaging speed of the medicine tablets is significantly slowed and setting of the delay time is very difficult and unreliable.

Due to the unreliable time delay, the shutter and the sealer cannot be precisely driven so that various errors occur during the packaging of the medical tablets.

SUMMARY OF THE INVENTION

Therefore, the present invention has been made in view of the above and/or other problems, and it is an object of the present invention to provide a dropping tablet detecting apparatus of an automatic medicine packaging machine for precisely detecting whether a tablet is dropped in a last hopper or not such that the packaging speed of the tablet is increased and a shutter and a sealer are precisely driven.

It is a further object of the present invention to provide a dropping tablet detecting apparatus of an automatic medicine packaging machine for precisely detecting a dropping tablet with a simple structure.

It is another object of the present invention to provide a dropping tablet detecting apparatus of an automatic medicine packaging machine in which a shutter is stably driven by a simple structure.

In accordance with the present invention, the above and other objects can be accomplished by the provision of an apparatus for detecting a dropping tablet in an automatic medicine packaging machine including a last hopper provided at the lower end of a hopper installed in a main frame, a shutter installed in the last hopper, and a shutter driving part for driving the shutter to open and close the last hopper such that a tablet, passing through the hopper from a tablet cassette and discharged into the last hopper, is inserted into packaging sheets by the shutter driving part and continuously packaged by a sealer under the control of a controller, the apparatus for detecting a dropping tablet including a dropping tablet detector installed in the last hopper to detect when the tablet is dropped into the last hopper and to input the detected information about the dropping tablet to the controller such that the moment when the shutter is opened is optimized.

Preferably, the dropping tablet detector includes a front through-hole and a rear through-hole, respectively penetrating the front side and the rear side of the last hopper, and an optical sensor installed to correspond to the front through-hole 11 and the rear through-hole to emit light to the tablet dropped down in the last hopper so as to detect the dropping tablet.

The optical sensor includes a plurality of light emitters arranged in the front through-hole in the horizontal direction to emit light to the inside of the last hopper, and the same number of light receivers as the number of light emitters arranged to correspond to the light emitters in the rear through-hole to detect the tablet dropping into the last hopper when the dropping tablet blocks the light emitted from the light emitters.

The shutter driving part includes a rotation pin rotatably installed to the upper side of the last hopper, coupled with the upper side of the shutter, and having a torsion spring, a trigger obliquely installed to the end of the rotation pin, an actuator for pressing the end of the trigger to rotate the rotation pin, and a motor mounted to the rear side of the main frame by a bracket to drive the actuator.

The actuator includes a rotation disc mounted to a spindle of the motor, a revolving pin eccentrically installed to the rotation disc and penetrating a through-hole formed in the main frame, and a pushing roller rotatably installed to the end of the angular moving pin to contact the trigger.

Moreover, the apparatus for detecting a dropping tablet in an automatic medicine packaging machine further includes a stopper pin installed in the bracket for fixing the motor and contacting the revolving pin to stop the revolution of the revolving pin to restrict the revolution of the revolving pin.

Preferably, the apparatus for detecting a dropping tablet in an automatic medicine packaging machine further includes a magnet installed to the outer circumference of the rotation disc, and a magnetic sensor for detecting the rotating angle of the rotation disc using magnetic field of the magnet.

BRIEF DESCRIPTION OF THE DRAWINGS

These and/or other objects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, an apparatus for detecting a dropping tablet in an automatic medicine packaging machine according to the preferred embodiment of the present invention will be described in detail with reference to the accompanying drawings.

Figure 1:
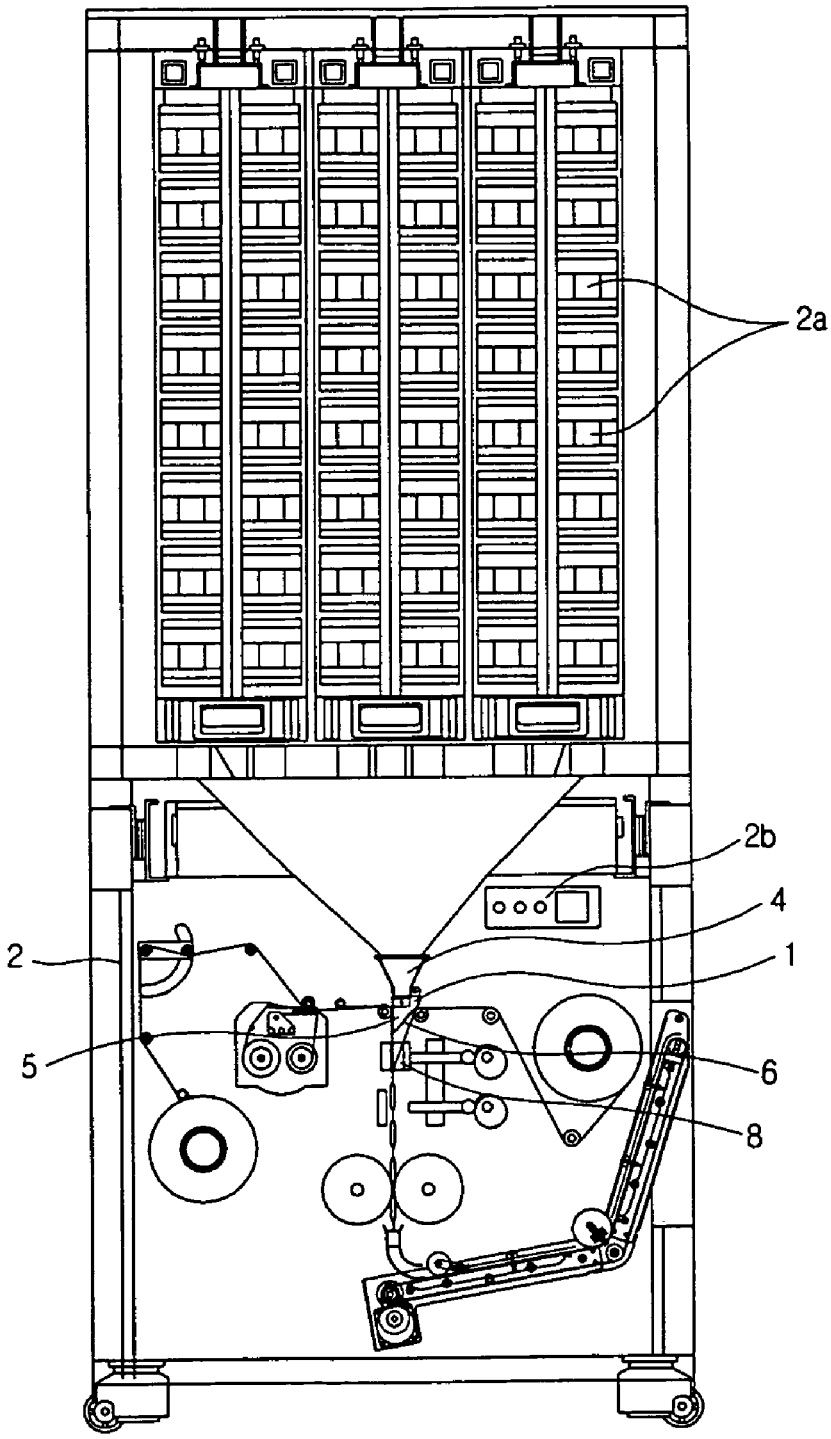
FIG. 1 is a schematic front sectional view illustrating an automatic medicine packaging machine employing an apparatus for detecting a dropping tablet according to a preferred embodiment of the present invention.

FIG. 1 is a schematic front sectional view illustrating an automatic medicine packaging machine employing an apparatus for detecting a dropping tablet according to a preferred embodiment of the present invention.

As shown in the drawings, the apparatus for detecting a dropping tablet in an automatic medicine packaging machine according to the first preferred embodiment of the present invention includes a dropping tablet detector 1 installed in a last hopper 5 disposed at the lower side of a hopper 4 of a main body 4 to detect when the tablet is dropped into the last hopper 5 and to input the detected information about the dropping tablet to a controller 2*b* such that the moment when the shutter 6 is opened is optimized.

The dropping tablet detector 1 detects a tablet dropping into the last hopper 5 after being dropped into the hopper 4 of the main body 2 from a tablet cassette 2*a* and inputs the detected information to the controller 2*b* such that the controller 2*b*, having received the detected information, controls a shutter 6 and a sealer 8 to be rapidly operated, thereby increasing the packaging speed of the tablet without setting of the time delay of the shutter 6 and the sealer 8.

In other words, the dropping tablet detector 1 detects the tablet dropping into the last hopper 5 such that the controller 2*b* precisely controls operations of the shutter 6 and the sealer 8.

Figure 2:
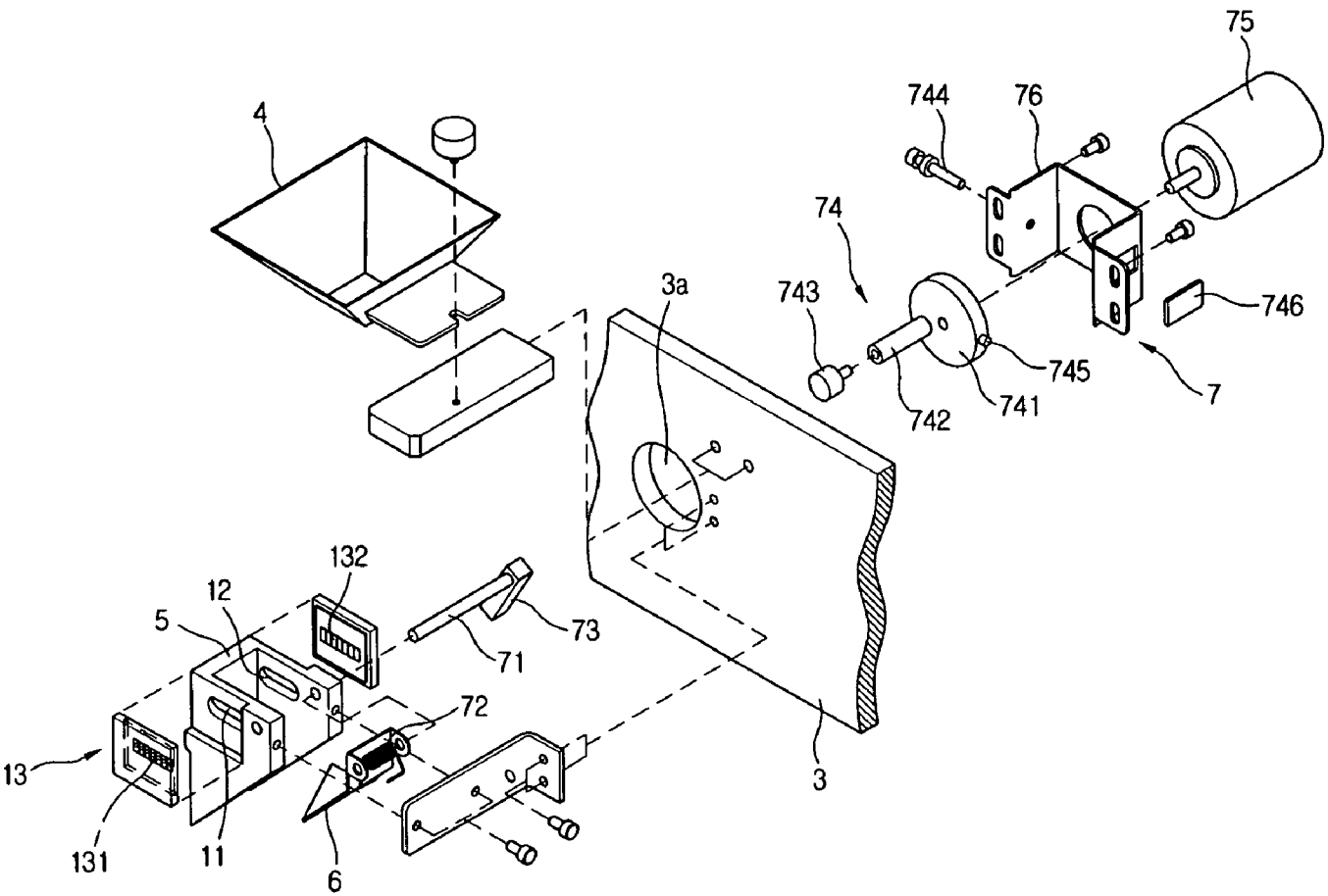
FIG. 2 is an enlarged exploded perspective view of main parts of the apparatus for detecting a dropping tablet according to a preferred embodiment of the present invention.
Figure 3:
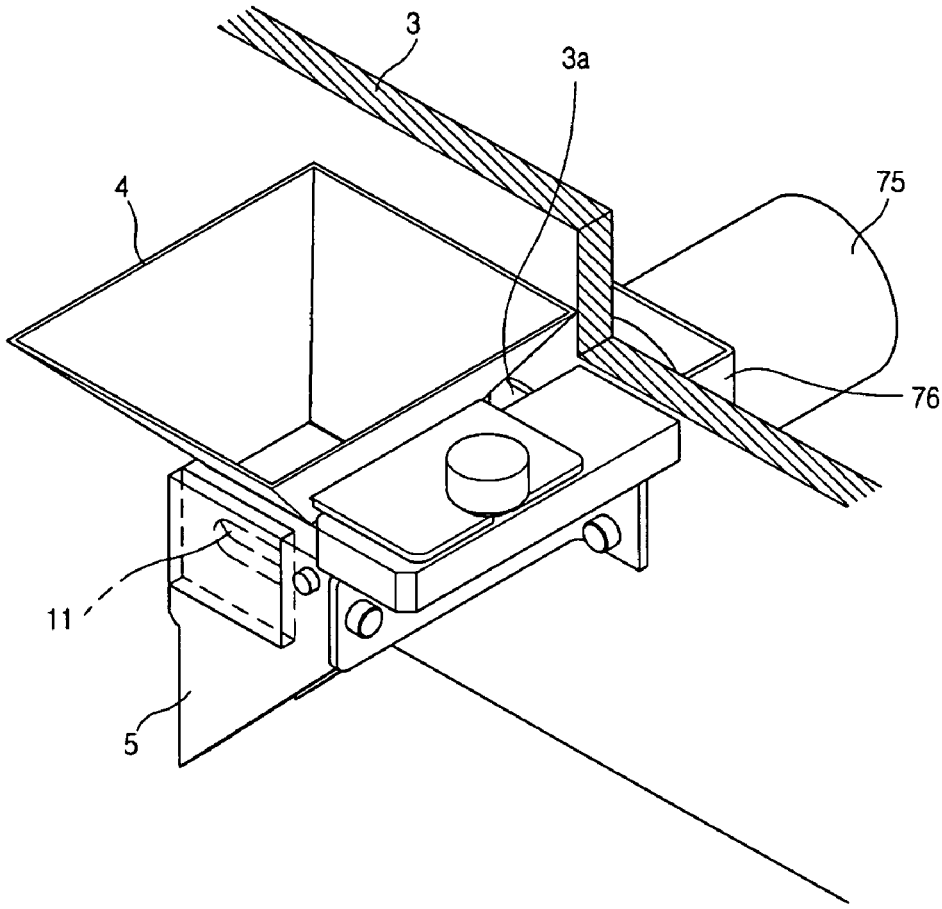
FIG. 3 is a perspective view of an assembly of the apparatus for detecting a dropping tablet in FIG. 2.
Figure 4:
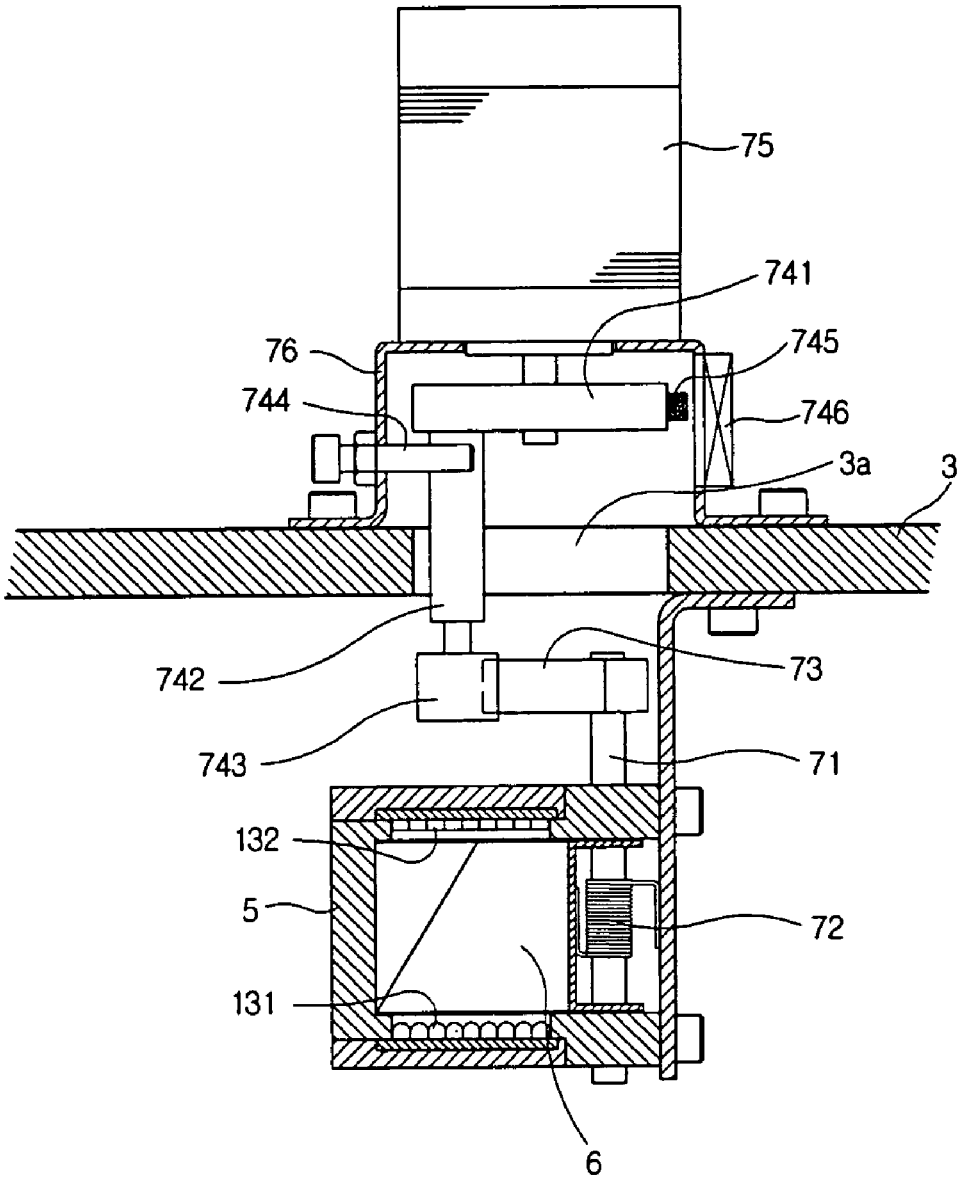
FIG. 4 is a plane sectional view of the main parts of the apparatus for detecting a dropping tablet according to a preferred embodiment of the present invention.

FIG. 2 is an enlarged exploded perspective view of main parts of the apparatus for detecting a dropping tablet according to a preferred embodiment of the present invention, FIG. 3 is a perspective view of an assembly of the apparatus for detecting a dropping tablet in FIG. 2, and FIG. 4 is a plane sectional view of the main parts of the apparatus for detecting a dropping tablet according to a preferred embodiment of the present invention.

As shown in the drawings, the dropping tablet detector 1 includes a front through-hole 11 and a rear through-hole 12, respectively penetrating the front side and the rear side of the last hopper 5, and an optical sensor 13 installed to correspond to the front through-hole 11 and the rear through-hole 12 to emit light to the tablet dropped down in the last hopper 5 so as to detect the dropping tablet.

The optical sensor 13 includes a plurality of light emitters 131 arranged in the front through-hole 11 in the horizontal direction to emit light to the inside of the last hopper 5, and the same number of light receivers 132 as the number of light emitters 131 arranged to correspond to the light emitters 131 in the rear through-hole 12 to detect the tablet dropping into the last hopper 5 when the dropping tablet blocks the light emitted from the light emitters 131.

The light emitters 131 and the light receivers 132 of the optical sensor 13 are arranged in the front and rear sides of the last hopper 5 to emit light through the inside of the last hopper 5 and to receive the emitted light through the front and rear through-holes 11 and 12.

The optical sensor 13 detects whether the tablet is dropped or not when the emitted light is intercepted or not such that a plurality of light emitters 131 horizontally arranged in the front through-hole 11 formed in the last hopper 5 emit a plurality of light beams toward the same number of light receivers 132 as the number of the light emitters 131 horizontally arranged in the rear through-hole 12 and the light receivers 132 receive the emitted light beams so that the optical sensor 5 detects that the tablet does not pass through the last hopper 5.

In addition, since, when the light beams emitted from the light emitters 131 are not received by the light receivers 132 and are intercepted instantly, the tablet is dropped into the last hopper 5 and intercepts the emitted light beams, the optical sensor 13 detects that the tablet is dropped into the last hopper 5 and is positioned on the shutter 6.

Moreover, the shutter 6 disposed at the lower side of the last hopper 5 is driven by the shutter driving part 7 to open and close the lower side of the last hopper 5 so as to discharge the tablet dropped into the last hopper 5 through the lower side.

As such, the shutter driving part 7 for opening and closing the shutter 6 includes a rotation pin 71 rotatably installed to the upper side of the last hopper 5, coupled with the upper side of the shutter 6, and having a torsion spring 72, a trigger 73 obliquely installed to the end of the rotation pin 71, an actuator 74 for pressing the end of the trigger 73 to rotate the rotation pin 71, and a motor 75 mounted to the rear side of the main frame 3 by a bracket 76 to drive the actuator 74.

The actuator 74 includes a rotation disc 741 mounted to a spindle of the motor 75, a revolving pin 742 eccentrically installed to the rotation disc 741 and penetrating a through-hole 3*a* formed in the main frame 3, and a pushing roller 743 rotatably installed to the end of the angular moving pin 742 to contact the trigger 73.

In the shutter driving part 7, when the rotation disc 741 is rotated at an angle by the motor 75 to revolve the revolving pin 742, the pushing roller 743 revolves to press the trigger 73 at an angle so that the rotation pin 71 coupled with the trigger 73 is rotated, whereby the shutter 6 coupled with the rotation pin 71 is rotated, the lower side of the last hopper 5 closed by the shutter 6 is opened, and the tablet accommodated in the last hopper 5 is discharged through the lower side of the hopper 5.

When the motor 75 is rotated in the reverse direction to the initial position after opening of the last hopper due to the rotation of the shutter 6, the revolving pin 742 is revolved in the reverse direction and the pushing roller 743 pressing the trigger 73 is returned to its initial position. Due to these movements, the torsion spring 72 elastically pressing the rotation pin 71 is returned to its initial position to restore the rotation pin 71 so that the shutter 6 is rotated to its initial position to close the lower side of the last hopper 5.

Moreover, a stopper pin 744 is installed in the bracket 76 for fixing the motor 75 and contacts the revolving pin 742. The stopper pin 744 stops the revolution of the revolving pin 742 to restrict the revolution of the revolving pin 742.

In addition, a magnet 745 is installed on the outer circumference of the rotation disc 741, and a magnetic sensor 746 for detecting the rotating angle of the rotation disc 741 using the magnetic field of the magnet 745. The magnetic sensor 746 detects the rotation angle of the rotation disc 741 and inputs the detected rotation angle to the controller 2*b* so that the motor 75 is controlled by the controller 2*b* and the opening and closing of the last hopper 5 are precisely performed by the shutter 6.

Figure 5:
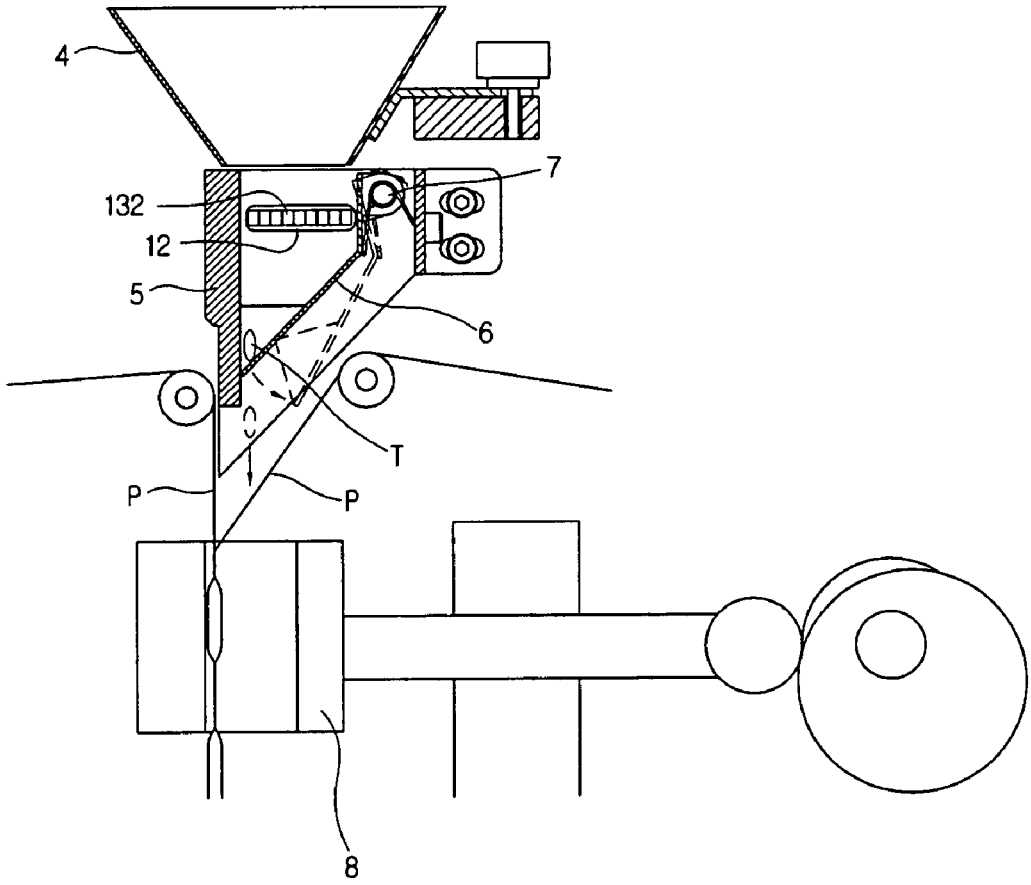
FIG. 5 is a front sectional view of main parts illustrating the operation of the apparatus for detecting a dropping tablet according to a preferred embodiment of the present invention.
Figure 6:
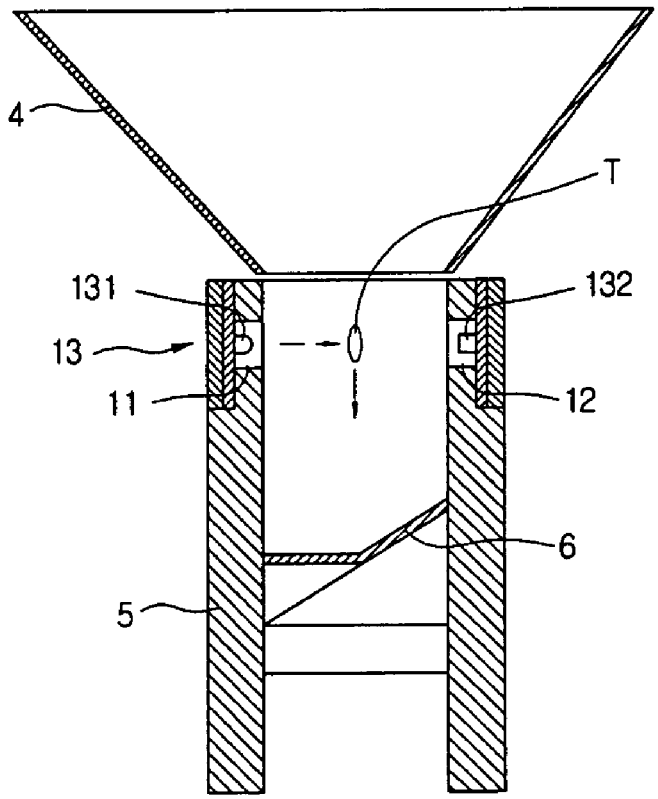
FIG. 6 is a side sectional view of the main parts illustrating the operation of the apparatus for detecting a dropping tablet according to a preferred embodiment of the present invention.
Figure 7:
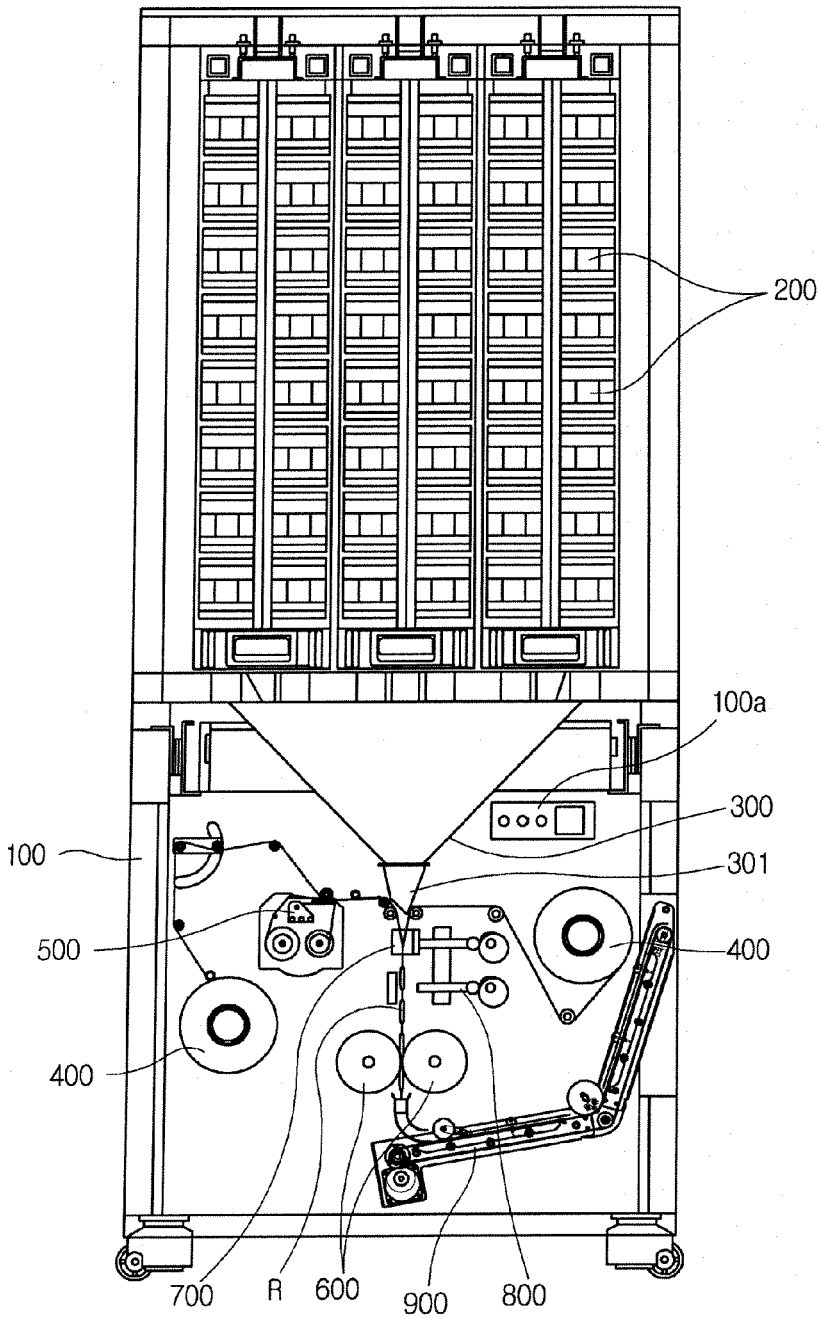
Fig.7 (Prior Art)
FIG. 7 is a front sectional view illustrating a conventional automatic medicine packaging machine.
Figure 8:
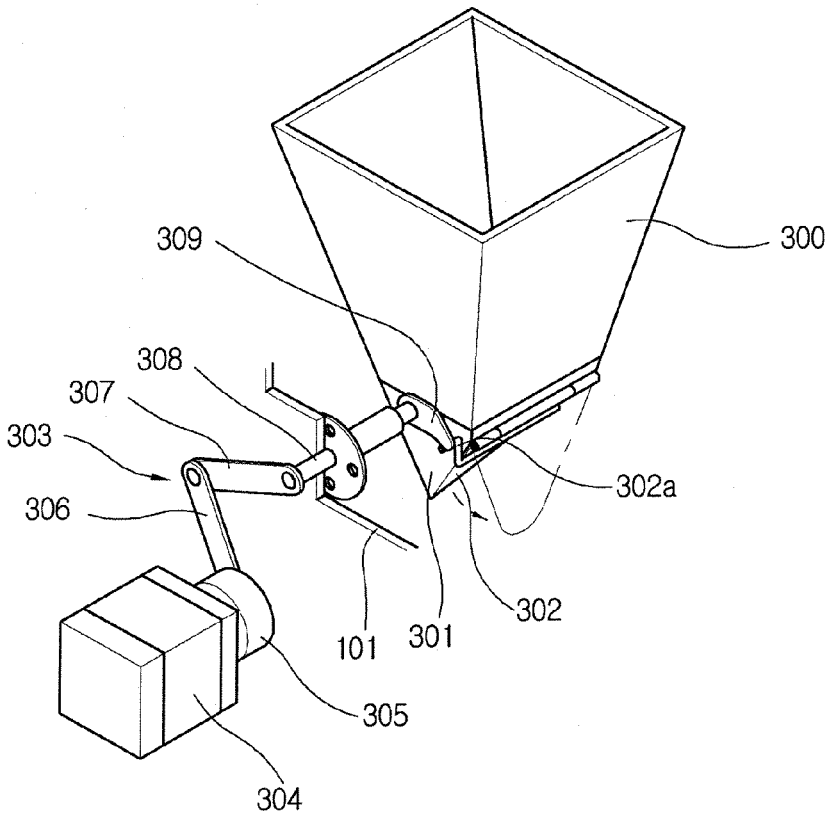
Fig.8 (Prior Art)
FIG. 8 is an enlarged rear side perspective view illustrating the conventional automatic medicine packaging machine.

FIG. 5 is a front sectional view of the main parts illustrating the operation of the apparatus for detecting a dropping tablet according to a preferred embodiment of the present invention, and FIG. 6 is a side sectional view of the main parts illustrating the operation of the apparatus for detecting a dropping tablet according to a preferred embodiment of the present invention.

As shown in the drawings, the tablet T dropped into the last hopper 5 from the hopper 4 passes through the inside of the last hopper 5, is dropped down, and is positioned on the shutter 6 closing the lower side of the last hopper 5.

As such, the optical sensor 13 detects the tablet T dropping through the last hopper 5 and inputs the detected information to the controller 2*b*. The detection is performed when light beams emitted from the light emitters 131 installed in the front through-hole 11 of the last hopper 5 to the light receivers 132 installed in the rear through-hole 12 are intercepted by the tablet T, and more particularly, is accurately and precisely performed even when the tablet T is continuously packaged one by one.

Moreover, the controller 2*b*, having received the detected information about the dropping tablet T from the optical sensor 13, drives the shutter driving part 7 to rotate the shutter 6 so that the lower end of the last hopper 5 is opened and the tablet T accommodated in the last hopper 5 is discharged through the lower side thereof, whereby the tablet T is inserted between the packaging sheets P of the sealer 8.

When the tablet T is inserted into the sealer 8, the controller 2*b* controls the sealer 8 to seal the packaging sheets P so as to package the tablet T.

Thus, the moment when the tablet T is dropped into the last hopper 5, is detected by the optical sensor 13 so that the controller 2*b* precisely controls the shutter 6 and the sealer 8.

As described above, according to the apparatus for detecting dropping tablets in an automatic medicine packaging machine, the tablets dropping into the last hopper are precisely detected to precisely drive the shutter and the sealer so that the packaging speed of tablets is increased, the tablets are stably and accurately packaged, operation of the shutter and the sealer is precisely performed, and the setting or adjustment of the delay time for the shutter and the sealer is unnecessary or remarkably convenient.

Since the apparatus for detecting dropping tablets in an automatic medicine packaging machine has a simple structure for precisely detecting the dropping tablets, its manufacturing and installation are convenient. Moreover, since uncertainty whether the tablet is dropped or not is removed, particularly, the tablets are effectively and accurately packaged when the tablets are packaged one by one.

In addition, since the apparatus for detecting dropping tablets in an automatic medicine packaging machine has a simple structure for stably driving the shutter, its manufacturing and installation are convenient, and stability of the shutter is significantly enhanced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for detecting a dropping tablet in an automatic medicine packaging machine comprising a last hopper provided at the lower end of a hopper installed in a main frame having a through-hole formed therein, a shutter installed in the last hopper, and a shutter driving part for driving the shutter to open and close the last hopper such that a tablet, passing through the hopper from a tablet cassette and discharged into the last hopper, is inserted into packaging sheets by the shutter driving part and continuously packaged by a sealer under the control of a controller, the apparatus for detecting a dropping tablet comprising:

a dropping tablet detector installed in the last hopper to detect when the tablet is dropped into the last hopper and to input the detected information about the dropping tablet to the controller, wherein the dropping tablet detector comprises:

a front through-hole and a rear through-hole, respectively penetrating a front side and a rear side of the last hopper; and an optical sensor installed to correspond to the front through-hole and the rear through-hole to emit light to the tablet dropped down in the last hopper so as to detect the dropping tablet;

wherein the shutter driving part comprises:

a rotation pin rotatably installed to an upper side portion of the last hopper, coupled with an upper side of the shutter, and having a torsion spring;

a trigger obliquely installed with respect to an end portion of the rotation pin;

an actuator configured for pressing an end portion of the trigger to rotate the rotation pin; and a motor mounted to a rear side portion of the main frame by a bracket configured to drive the actuator; and wherein the actuator comprises a rotation disc mounted to a spindle of the motor; a revolving pin eccentrically installed on the rotation disc and penetrating the through-hole formed in the main frame; and a pushing roller rotatably installed on an end portion of the angular moving pin to contact the trigger.

2. The apparatus for detecting a dropping tablet in an automatic medicine packaging machine as set forth in claim 1, wherein the optical sensor comprises:

a plurality of light emitters arranged in the front through-hole in the horizontal direction to emit light to the inside of the last hopper; and a same number of light receivers as the number of light emitters arranged to correspond to the light emitters in the rear through-hole to detect the tablet dropping into the last hopper when the dropping tablet blocks the light emitted from the light emitters.

3. The apparatus for detecting a dropping tablet in an automatic medicine packaging machine as set forth in claim 1, further comprising:

a stopper pin installed on the bracket for fixing the motor and contacting the revolving pin to stop revolving of the revolving pin and to restrict revolution of the revolving pin.

4. The apparatus for detecting a dropping tablet in an automatic medicine packaging machine as set forth in claim 3, further comprising:

a magnet installed on an outer circumference of the rotation disc; and a magnetic sensor configured for detecting the rotating angle of the rotation disc using a magnetic field of the magnet.

* * * * *